United States Patent [19]

Kasting et al.

[11] Patent Number: 4,471,731

[45] Date of Patent: Sep. 18, 1984

[54] ROCKER HOUSING AND ROCKER COVER

[75] Inventors: Edward W. Kasting, Seymour; Richard E. Glasson; Bryan W. Swank, both of Columbus, all of Ind.

[73] Assignee: Cummins Engine Company, Inc., Columbus, Ind.

[21] Appl. No.: 349,896

[22] Filed: Feb. 18, 1982

Related U.S. Application Data

[62] Division of Ser. No. 104,791, Dec. 18, 1979, Pat. No. 4,345,552.

[51] Int. Cl.[3] ..... F01M 9/10

[52] U.S. Cl. ..... 123/90.38; 123/195 C

[58] Field of Search ..... 123/52 M, 90.38, 195 C, 123/198 E

[56] References Cited

U.S. PATENT DOCUMENTS

| | | | |
|---|---|---|---|
| 2,607,331 | 8/1952 | Wefing | 123/90.38 |
| 3,194,221 | 7/1965 | Dinger et al. | 123/90.38 |
| 3,822,763 | 7/1974 | Adams et al. | 123/90.38 |
| 4,066,058 | 1/1978 | Anderkay | 123/198 E |
| 4,067,531 | 1/1978 | Sikula | 123/198 E |
| 4,164,927 | 8/1979 | Congram et al. | 123/90.38 |
| 4,369,627 | 1/1983 | Kasting et al. | 123/52 M |

FOREIGN PATENT DOCUMENTS

| | | | |
|---|---|---|---|
| 2723459 | 1/1978 | Fed. Rep. of Germany | 123/195 C |
| 1066415 | 6/1954 | France | 123/90.38 |
| 0499667 | 1/1939 | United Kingdom | 123/90.38 |

*Primary Examiner*—Craig R. Feinberg
*Assistant Examiner*—W. R. Wolfe
*Attorney, Agent, or Firm*—Sixbey, Friedman & Leedom

[57] ABSTRACT

An aluminum rocker housing (10) is secured to the cylinder head (8) of an internal combustion engine (2) to surround and protect the cylinder valve assemblies (156, 158) and associated rocker arm mechanism. The front face (58) of the rocker housing (10) includes a recessed surface (68) which forms an air intake plenum (60) for receiving pressured air from the engine turbocharger (48). Air intake passageways (84, 86, 88) cast to the rear of the front face (58) communicate with the air intake plenum (60) and simultaneously register with air intake ports (160) formed in the cylinder head (8) to provide a means for distributing air from the air intake plenum (60) to the cylinders (16). A rocker cover (12) molded from plastic is secured to the rocker housing (10) by a plurality of vibration-damping bolt assemblies (13). The rocker cover (12) contains a drip lip (148) to prevent engine lubricants from coming into contact with the rocker cover gasket (14). The rocker cover (12) also includes a means (151) for engaging the gasket (14) to increase the sealing capacity thereof.

21 Claims, 23 Drawing Figures

8
10
12
13
14
9
11
26
34
36
38
39
86
126
132
135
136
144
148
151
152
154
156
158
160
162
164
166
168
I-I
II-II
III-III

ROCKER HOUSING AND ROCKER COVER

This application is a division of application Ser. No. 104,791, filed Dec. 18, 1979, now U.S. Pat. No. 4,435,552.

TECHNICAL FIELD

This invention relates to rocker housings and rocker covers for use with internal combustion engines and more particularly to an improved rocker housing and rocker cover assembly which surrounds and protects the cylinder valve assemblies and rocker arm mechanism mounted on the engine cylinder head.

BACKGROUND ART

Internal combustion engineers have long recognized the desirability of reducing the weight of the various components in an internal combustion engine. Concommitantly, engineers have sought to simplify the casting and molding of these various components in order to reduce the costs of producing the engine.

It is often difficult to meet simultaneously the goals of reducing both engine weight and complexity, but relatively recent efforts by the internal combustion engine industry have resulted in new engine design concepts which incorporate several heretofore conventional features of the engine into one lightweight, simplified structural unit. For example, U.S. Pat. No. 3,411,490, issued to Akana on Nov. 19, 1968, and U.S. Pat. No. 3,832,983, issued to Nickly on Sept. 3, 1974, both disclose cylinder heads for internal combustion engines wherein longitudinal recesses formed in the sides of the cylinder heads are used in lieu of conventional intake manifolds to provide a receiving chamber or plenum from which intake air is distributed to the cylinders. Akana in particular recognizes the advantages of reduced weight and lessened fabrication costs inherent in a combined intake manifold/cylinder head arrangement. Despite the utility of both the Akana and Nickly inventions, however, the weight and cost advantages obtained by combining the intake manifold with the cylinder head are limited by the fact that the cylinder head itself is generally cast from a sand mold which must be rebuilt after each casting. Consequently, even though a combined intake manifold/cylinder head assembly may be less complex to reproduce than separate intake manifold and cylinder head components, truly significant reductions in the casting costs of the cylinder head can only be achieved if the air intake collection and distribution structure is at least partially removed from the head and placed in an engine component capable of manufacture by a reusable die.

U.S. Pat. No. 3,973,548, issued to Celli on Aug. 10, 1976, discloses an internal combustion engine with die cast static parts including a die cast cylinder head attached to the engine cylinder casting and a die cast valve train casing secured to the top of the cylinder head. A group of air passageways formed in the interior of the valve train casing communicate with respective intake passageways in the cylinder head to supply air at atmospheric pressure to the intake ports of the cylinders. Such placement of a portion of the air intake system in the valve train casing results in a simplified cylinder head construction, thus enabling Celli to employ cost and weight efficient die-casting techniques in the manufacture of his engine components. Nevertheless, the teachings of Celli are not readily adaptable to all types of internal combustion engines. In particular, those engines which require pressurized or otherwise pre-conditioned intake air will be unable to benefit from the Celli valve train casing. This is because the air passageways formed in the valve train casing all open directly to the atmosphere, and Celli makes no provision for collecting his intake air in a manifold-type structure prior to distributing the air to the cylinders. In situations where, for example, turbocharging or after-cooling capability is required, it is necessary to construct an engine component separate from the cylinder head yet able to centrally receive and collect the intake air from the pre-conditioning source prior to distribution if the weight and cost advantages discussed in Celli are to be fully exploited.

Apart from internal combustion air intake systems, engineers have turned to other portions of the engine in their search for ways to reduce engine weight. One solution to the weight problem has been to employ plastic engine components wherever possible. U.S. Pat. No. 4,101,003, issued to Timour et al on July 18, 1978 and assigned to the assignee of the present invention, discloses an oil pan assembly which may be molded from plastic. Other engine components, if properly designed, could also be formed from plastic material. However, as pointed out by Timour et al, plastic is particularly susceptible to engine vibration and plastic engine components often produce undesirable levels of noise. Consequently, the prior design of such components requires the provision of means to damp vibrations arising during operation of the engine.

The isolated rocker arm cover disclosed in U.S. Pat. No. 4,027,644, issued to Timour on June 7, 1977 and also assigned to the assignee of the present invention, directly addresses the problem of damping noise-producing vibrations in internal combustion engine components. Timour utilizes an elongated elastomeric seal element which extends from a groove formed around the periphery of the rocker arm cover to isolate the cover from the engine, thereby damping vibrations which would otherwise be transmitted directly from the engine to the cover. Bolts with resilient fastener assemblies hold the cover in place, and elastomeric grommets surround the bolts to prevent any indirect transfer of vibrations between the cover and the engine. Although Timour provides an adequate means for diminishing the noise emanating from the rocker arm cover, the width of the elongated elastomeric element which seals the periphery of the rocker arm cover is not sufficient to prevent oil leakage therethrough during periods of heavy engine vibration. The provision of a more substantial sealing arrangement around the rocker arm cover is thus necessary if the vibration-damping features of Timour are to be effectively applied to heavy-duty internal combustion engines subject to large vibrational stresses.

DISCLOSURE OF INVENTION

It is therefore a primary object of the present invention to provide a means for reducing the weight and complexity of various components in an internal combustion engine.

It is an additional object of the present invention to provide a lightweight, durable rocker housing incorporating an intake manifold therein in the form of an air intake plenum, which plenum is adapted to receive air from an air intake pre-conditioning means such as a turbocharger.

It is yet an additional object of the present invention to provide a rocker housing with an air intake plenum having a plurality of air intake passageways diverging therefrom to distribute intake air respectively to a plurality of air intake ports formed in the engine cylinder head.

It is a further object of the present invention to provide an aluminum rocker housing which may be cast from a reusable mold.

It is also an object of the present invention to provide a rocker arm cover which may be molded from plastic and attached to the engine rocker housing in a manner such that the transfer of vibrations between the rocker housing and the rocker cover is damped.

The present invention basically comprises a wedge-shaped rocker housing which is secured to the cylinder head of an internal combustion engine and encloses the engine fuel injector, valve assemblies and associated rocker arm mechanism mounted on the cylinder head. The front face of the rocker housing includes a recessed surface which forms an air intake plenum for receiving pressured air from the engine turbocharger. The air intake plenum, together with a plate bolted to the front of the rocker housing, serves as a substitute for a conventional intake manifold. If desired, an optional aftercooler unit may be attached to the front face in lieu of the plate. Air intake passageways cast to the rear of the front face communicate with the air intake plenum via intake ports formed in the recessed surface. The air intake passageways in turn register with air intake ports formed in the cylinder head to provide a means for distributing air from the air intake plenum to the cylinders. A rocker cover formed from plastic is secured to the rocker housing by a plurality of vibration-damping bolt assemblies. Oil leakage from the rocker housing is minimized by a gasket inserted between the rocker housing and the rocker cover, while a drip lip extending around the inner periphery of the rocker cover presents engine lubricants which have been disbursed into the area enclosed by the rocker cover from coming into contact with the gasket. A small bead formed around the periphery of the rocker cover bites into the gasket when the bolt assemblies are tightened to increase the sealing capacity of the gasket. The rocker cover additionally contains longitudinal and lateral reinforcing ribs.

The various features, objects and advantages of the present invention will become apparent from the following Brief Description of the Drawings and Best Mode for Carrying Out the Invention.

BEST MODE FOR CARRYING OUT THE INVENTION

The rocker housing of the present invention is particularly suitable for use with an in-line multiple cylinder diesel engine of the type disclosed in co-pending application Ser. No. 958,532 (filed: Nov. 7, 1978), assigned to the assignee of the present invention and incorporated herein by reference.

Figure 1:
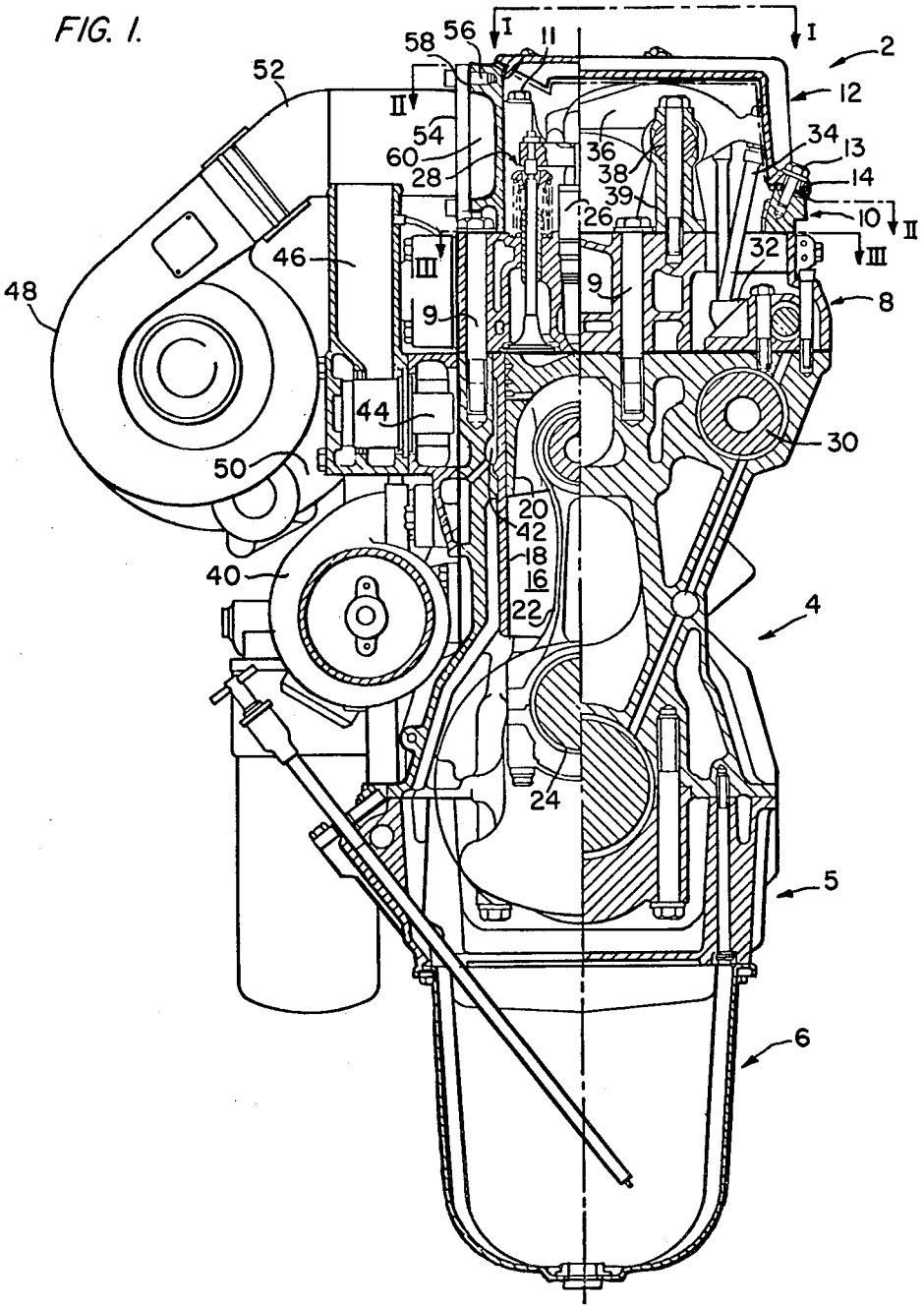
FIG. 1 is a cross-sectional view of an inline muliple cylinder diesel engine employing the rocker housing and rocker cover of the present invention.

Referring to FIG. 1, an in-line multiple cylinder diesel engine is indicated generally at 2. The engine includes block 4 which may be constructed as set forth in co-pending application Ser. No. 22,647 (filed Mar. 21, 1979), now U.S. Pat. No. 4,237,847 also assigned to the assignee of the present invention and also incorporated herein by reference. A ladder frame 5 and pan 6 are attached to the lower portion of block 4. A cylinder head 8 is secured to the upper side of the block by a plurality of bolts 9. Rocker housing 10, which surrounds and protects the engine valve assemblies and rocker arm mechanism, is fastened to cylinder head 8 by a plurality of bolts 11, and rocker cover 12 is fastened to rocker housing 10 by a plurality of bolts 13. A soft gasket 14, i.e., a gasket in the range of 30–70 durometers, is positioned between rocker housing 10 and rocker cover 12 to provide an oil seal. Gasket 14 is clamped into place when bolts 13 are tightened.

In a preferred embodiment of the present invention, six in-line cylinders are formed in block 4, but only the number one cylinder 16 is illustrated in cross-section in FIG. 1. Cylinder 16 includes a liner 18, within which piston 20 fastened to the upper end of connecting rod 22 is reciprocally mounted. Connecting rod 22 is rotatably fastened to a crankshaft 24, and crankshaft 24 is in turn rotatably supported on the engine block 4 by bearings (not shown). Although one cylinder and piston assembly is described, it is understood that the remaining five cylinder/piston assemblies are similarly disposed in-line within engine block 4. Of course, an appropriately modified version of the present invention may be employed with an engine containing any numeber of cylinders constructed in either an in-line or V configuration.

Cylinder head 8 supports a fuel injector 26 and a valve assembly, partially shown at 28 in FIG. 1, for each cylinder. Each valve assembly includes a pair of intake valves and a pair of exhaust valves which respectively control the flow of gases into and out of the cylinder, as will as discussed in greater detail hereinbelow. Each individual valve and fuel injector is synchronously activated by a cam drive mechanism such as disclosed in previously mentioned application Ser. No. 958,532. Briefly, a series of cams (not shown) carried by a rotating cam shaft 30 respectively impart motion to a series of cam followers 32 in accordance with the contours of the outer surfaces of the cams. The motion of the cam followers 32 is transmitted via push rods 34 to the ends of rocker arms 36, whereupon the rocker arms pivot about rocker shafts 38 supported by pedestals 39 mounted on cylinder head 8. The ends of rocker arms 36 opposite push rods 34 thereafter operatively engage respective valves and fuel injectors to activate the valves and fuel injectors in a sequence determined by the placement of the cams on cam shaft 30. For example, as each piston nears the end of its compression stroke the injector cam associated therewith drives the associated push rod 34 upwardly to pivot the associated rocker arm 36 and force the plunger on the fuel injector downward, thus injecting fuel for combustion into the upper end of the cylinder. In similar fashion, the intake valves are opened to admit air to the cylinder during the air intake stroke of the piston and the exhaust valves are opened to expel exhaust gases from the cylinder during the exhaust stroke of the piston.

A liquid coolant flow system, also disclosed in the aforementioned co-pending application Ser. No. 958,532, is employed to maintain the operating temperatures of the engine within acceptable limits. The system utilizes a coolant circulating pump 40 in combination with an annular coolant chamber 42 which surrounds cylinder liner 16, flow passages (not shown) formed in cylinder head 8 and block 4, passage 44 and duct 46 to achieve the desired coolant flow pattern.

Air is supplied to the engine cylinders by a turbocharger unit 48 mounted on one side of the engine. Turbocharger 48 may be of the type disclosed in co-pending application Ser. No. 82,284 (filed Oct. 5, 1979), now U.S. Pat. No. 4,294,073 also assigned to the assignee of the present invention and also incorporated herein by reference. The turbocharger includes a turbine (not shown) which is driven by engine exhaust gases received through an exhaust manifold formed from a plurality of ducts 50 connected between cylinder head 8 and the turbine. The turbocharger further includes a compressor (not shown) which supplies intake air under pressure through a duct 52 attached to a plate 54. Plate 54 is secured by bolts 56 to the front face 58 of rocker housing 10 and covers an air intake plenum 60 which is formed in the rocker housing to receive pressurized air from the turbocharger compressor. The pressurized air is then distributed to the engine cylinders through air intake passageways formed in rocker housing 10 and cylinder head 8. Plate 54 and air intake plenum 60 serve as a substitute for the intake manifold heretofore employed in conventional internal combustion engine air intake systems.

Figure 2:
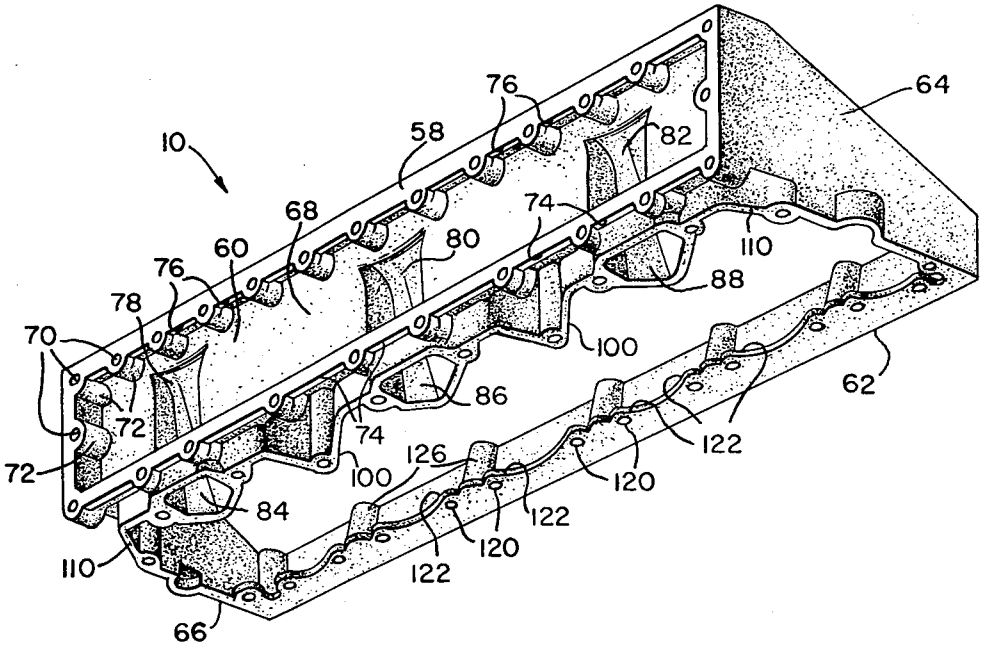
FIG. 2 is a perspective view of the bottom and front face of the rocker housing showing the relationship between the rocker housing air intake passageways and the front face.

Rocker housing 10 is illustrated in detail in FIGS. 2–5. FIG. 2 is a perspective view of the rocker housing, while FIGS. 3, 4 and 5 respectively furnish top, side and front views of the rocker housing. Referring first to FIG. 2, it can be seen that rocker housing 10 comprises a hollow cast structure having previously mentioned front face 58, a rear wall 62 and two connecting walls 64, 66. As seen to best advantage in FIG. 4, the height of front face 58 is greater than the height of rear wall 62, thus giving rocker housing 10 a generally wedge-shaped appearance. Connecting walls 64 and 66 join front face 58 and rear wall 62 at right angles thereto. The bottom surfaces of the front face 58, rear wall 62 and connecting walls 64, 66 form a plane which is parallel to the top surface of cylinder head 8. The surfaces of front face 58, rear wall 62 and connecting walls 64, 66 are generally perpendicular to this plane.

Figure 5:
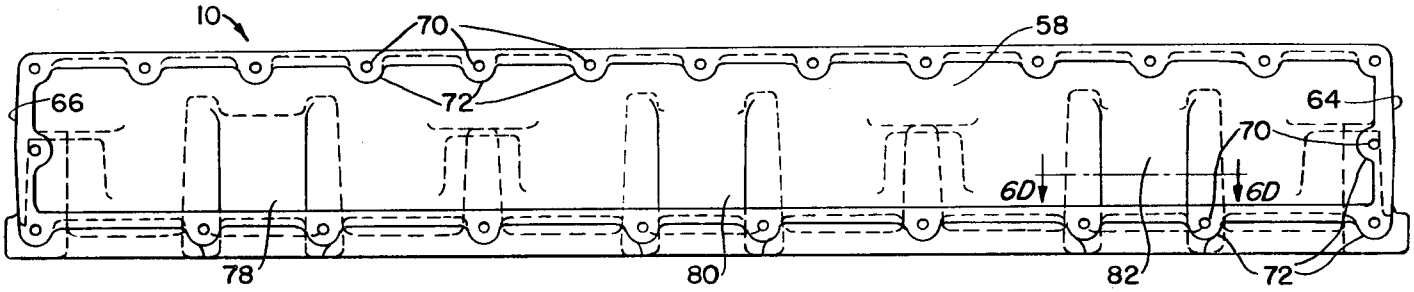
FIG. 5 is a front elevational view of the rocker housing.

In the following discussion, reference may additionally be had to FIGS. 6A through 6F illustrating the various cross-sections of rocker housing 10 indicated in FIGS. 3 and 5. As seen to best advantage in FIGS. 2 and 6A–6F, the front face 58 of the rocker housing includes a recessed surface 68 which forms the air intake plenum 60 for receiving pressurized air from turbocharger 48 as described above. Recessed surface 68, together with plate 54 (see FIG. 1), serves as a substitute for a conventional intake manifold. Plate 54 is secured to the front face 58 of rocker housing 10 by bolts 56 which are threaded into a plurality of threaded holes 70 bored into a corresponding plurality of bosses 72 cast around the periphery of front face 58. Front face 58 further includes a first series of lips 74 molded between the bottom row of bosses 72, shown in particular in FIG. 6A, and a second series of lips 76 molded between the top row of bosses 72, shown in particular in FIG. 6B.

Three air intake ports 78, 80 and 82 are formed in recessed surface 68 and respectively communicate with three rocker housing air intake passageways 84, 86 and 88 cast to the rear of rocker housing front face 58. Each of the rocker housing air intake passageways 84, 86, 88 registers with an air intake port formed in cylinder head 8, as described more fully hereinbelow.

Figure 6C:
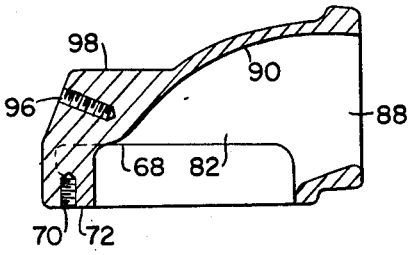
Figure 6D:
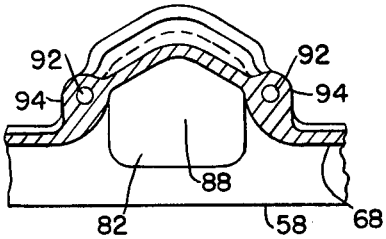

FIGS. 6C and 6D provide side and top cross-sectional views of air intake port 82 and air intake passageway 88, although it is understood that the remaining air intake ports and passageways are similarly constructed. Air intake passageway 88 angles away from air intake port 82, and the rear surface of the air intake passageway thereafter curves downward in an arc, indicated at 90 in FIG. 6C, to terminate at the bottom of the rocker housing. Referring to FIG. 6D, holes 92 formed in bosses 94 cast on each side of the air intake passageway accomodate bolts 11 for anchoring the rocker housing 10 to cylinder head 8. In addition, as shown in FIG. 6C, a threaded hole 96 bored at a right angle into the inclined surface of a boss 98 cast on the top of air intake passageway 88 is adapted to receive bolt 13 for securing rocker cover 12 to rocker housing 10.

Figure 6E:
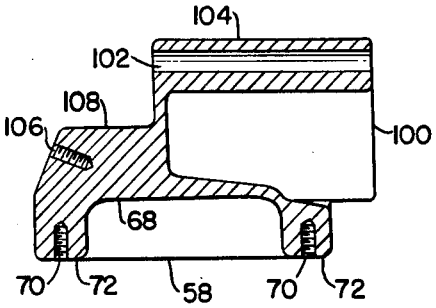

Two triangular-shaped reinforcing skirts 100, illustrated in FIGS. 2 and 3 and again in cross-section in FIG. 6E, are cast between successive rocker housing air intake passageways 84, 86 and 86, 88. Holes 102 formed in bosses 104 cast at the apex of each skirt accomodate additional bolts 11 for anchoring rocker housing 10 to cylinder head 8, while threaded holes 106 bored at right angles into the inclined surfaces of bosses 108 cast on the top of the triangular-shaped skirts 100 provide additional means for receiving bolts 13 to secure rocker cover 12 to the top of rocker housing 10. It can be seen in FIG. 6E that triangular-shaped skirts 100 are hollow in order to provide clearance for the bolts 9 which fasten cylinder head 8 to block 4.

Figure 6F:
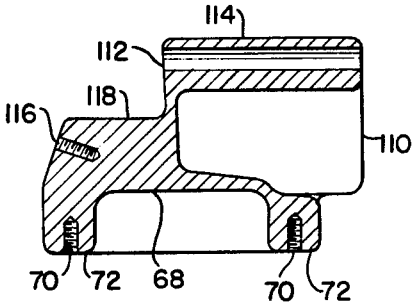

Corner skirts 110 reinforce the inside corners of rocker housing 10, respectively linking the rear portion of front face 58 with connecting walls 64 and 66. FIG. 6F is a cross-section of the right-hand corner skirt 110 linking the rear portion of front face 58 with connecting wall 64. Holes 112 formed in bosses 114 cast at the juncture of corner skirts 110 and the connecting walls 64, 66 accomodate bolts 11 for anchoring rocker housing 10 to cylinder block 8, and threaded holes 116 bored at right angles into the inclined surfaces of bosses 118 cast in the corner between front face 58 and connecting walls 64, 66 receive bolts 13 for securing rocker cover 12 to rocker housing 10.

Figure 3:
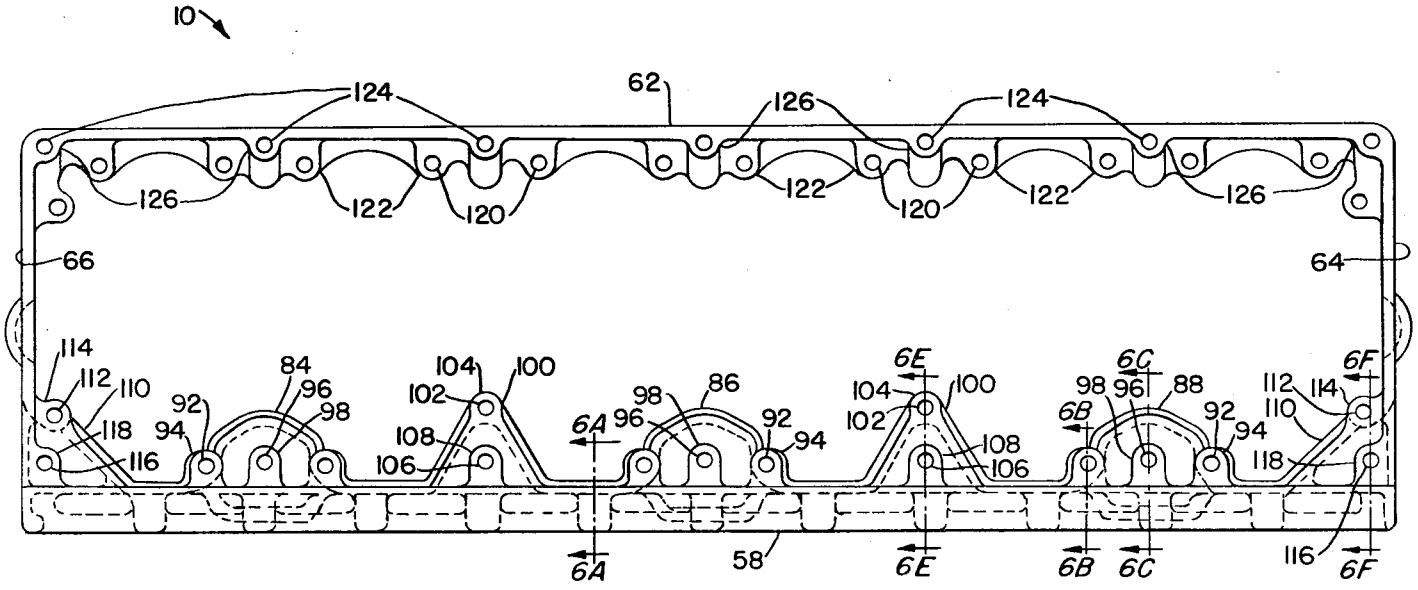
FIG. 3 is a top view of the rocker housing.
Figure 6B:
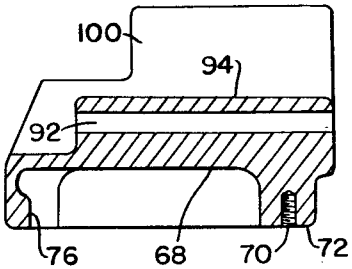
FIGS. 6A through 6F illustrate various cross-sectional views of the rocker housing as indicated in FIGS. 3 and 5.
Figure 6A:
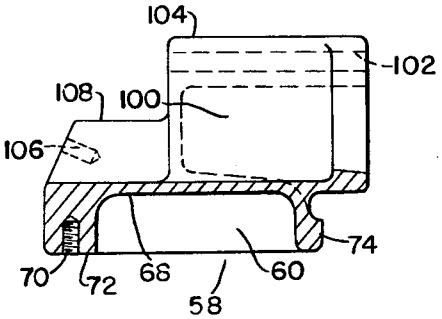
Figure 4:
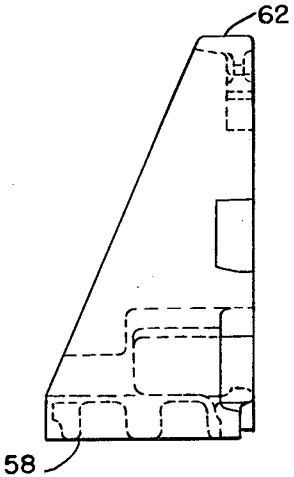
FIG. 4 is a side elevational view of the rocker housing.

Finally, as shown to best advantage in FIGS. 2 and 3, a plurality of holes 120 formed in a plurality of bosses 122 cast along the inner length of rear wall 62 accomodate the last of the bolts 11 for anchoring rocker housing 10 to cylinder head 8, while another plurality of threaded holes 124 bored at right angles into the inclined surfaces of bosses 126 also cast along the inner length of rear wall 62 act to receive a final set of bolts 13 for securing rocker cover 12 to rocker housing 10.

Numerous advantages are obtained by employing a rocker housing constructed in accordance with the foregoing description. For example, use of the rocker housing air intake plenum 60 instead of a conventional intake manifold results in a shorter, more direct air flow path between the turbocharger and the engine cylinders, thus permitting more efficient turbocharger operation and greater engine compactness. Moreover, placing the air intake plenum in the rocker housing, as opposed to the cylinder head, allows the size of the plenum to be increased without increasing the bulk of the engine.

If desired, rocker housing 10 may be cast from aluminum to provide a significant reduction in the weight of the material required for the engine. Additional weight reduction is achieved by eliminating the need for a conventional cast intake manifold. Placement of the plenum 60 and air intake passageways 84, 86, 88 in the rocker housing also simplifies the structure of the cast iron cylinder head, further adding to the net weight savings in the engine.

Certain cost savings can be realized by using the rocker housing of the present invention. As a general rule, cylinder heads are cast in sand molds, and such molds must be rebuilt after each casting. Placing the initial portion of the air collection and distribution structure in the rocker housing, however, leads to a simplified cylinder head air intake system and a corresponding reduction in the complexity of the cylinder head sand mold which must be rebuilt after each casting. Consequently, the cost of the head casting operation will be lowered. On the other hand, the mold for the aluminum rocker housing can be constructed in semipermanent form and reused after each rocker housing casting. Any increase in the complexity of the reusable rocker housing mold is more than offset by the reduction in complexity of the temporary cylinder head mold, thereby significantly increasing the overall economy of production of these engine components.

Figure 7:
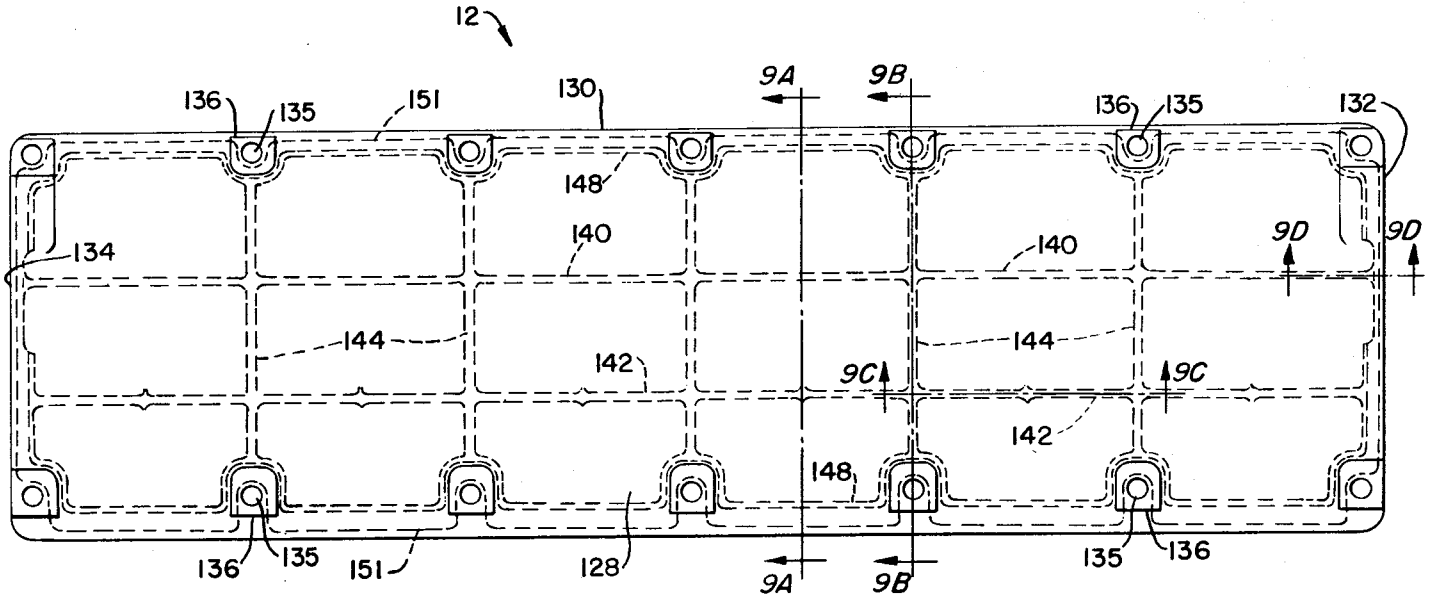
FIG. 7 is a top view of the rocker cover.
Figure 8:
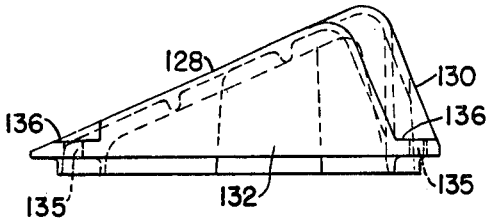
FIG. 8 is a side elevational view of the rocker cover.

FIGS. 7 through 10 illustrate rocker cover 12 in detail. Top and side views of rocker cover 12 are respectively provided by FIGS. 7 and 8, while FIGS. 9A through 9F furnish the various cross-sectional views of the rocker cover indicated in FIG. 7. Referring first to FIGS. 7 and 8, rocker cover 12 comprises a wedge-shaped molded plastic structure which conforms in both length and width to the length and width of rocker housing 10. Rocker cover 12 includes a top surface 128, a rear surface 130, and two triangular end sections 132, 134. A plurality of holes 135 formed in a corresponding plurality of recessed flanges 136 molded into both top and rear surfaces 128, 130 accomodate the bolts 13 which secure rocker cover 12 to rocker housing 10. The thickness of flanges 136 is generally greater than the thickness of top and rear surfaces 128, 130 and triangular end sections 132, 134. If desired, the firing information for the engine cylinders can also be molded into top surface 128.

Figure 9E:
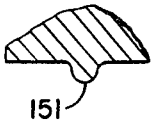
FIGS. 9A through 9E illustrate various cross-sectional views of the rocker cover as indicated in FIG. 7.
Figure 9A:
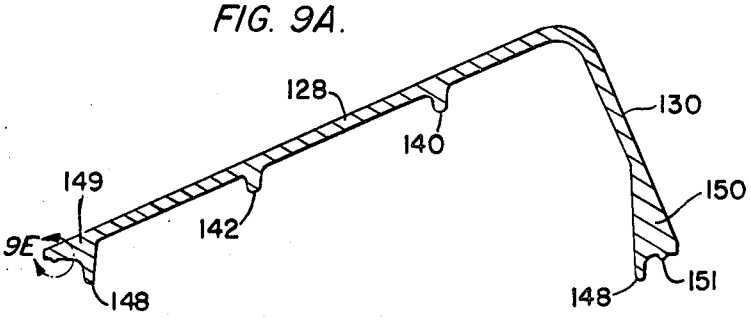
Figure 9B:
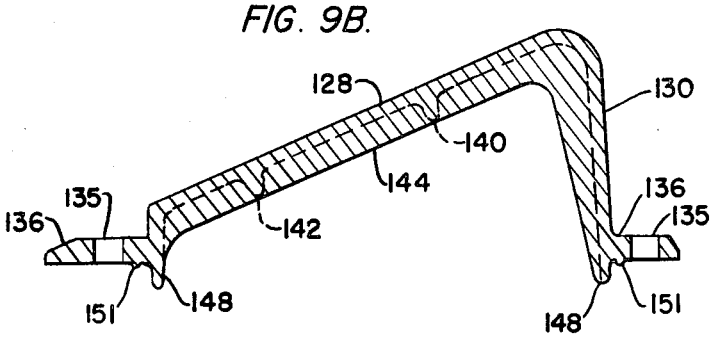
Figure 9C:
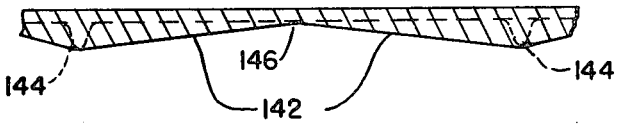

Two series of longitudinal reinforcing ribs, indicated at 140 and 142 respectively in FIG. 9A, are formed along the underside of top surface 128. Both sets of longitudinal reinforcing ribs 140, 142 intersect a series of lateral reinforcing ribs, indicated at 144 in FIG. 9B, at right angles thereto. As shown in FIG. 9C, the series of longitudinal reinforcing ribs 142 nearest the apex of triangular sections 132, 134 are generally inclined, beginning at point 146 midway between adjacent lateral reinforcing ribs 144 on he underside of top surface 128 and generally increasing to a maximum height at the right angle intersections with the lateral reinforcing ribs 144. This arrangement of reinforcing ribs provides adequate clearance for the operation of rocker arms 36 when rocker cover 12 is secured to rocker housing 10.

Referring again to FIGS. 7, 9A and 9B, a lip 148 extends around the inner periphery of the bottom of rocker cover 12, terminating for a short distance along the portion of triangular wall 132 shown in cross-section in FIG. 9D and again terminating for a short distance along a similar portion of triangular wall 134. Lip 148 serves to minimize oil leakage from the rocker housing 10 by diverting droplets of oil or other lubricant away from the sealing gasket 14 clamped between rocker cover 12 and rocker housing 10. The droplets are condensed or thrown onto the inside surface of rocker cover 12 during operation of the rocker mechanism, and under the force of gravity flow or drip downwardly past gasket 14 to the tip of lip 148. An extra thickness of plastic, seen at 149 in FIG. 9A, joins lip 148 to top surface 128 in the area between the flanges 136 on top surface 128, while another extra thickness of plastic, indicated at 150 in FIG. 9A, similarly joins lip 148 to rear surface 130 in the area between the flanges 136 on rear surface 130. This extra plastic provides further reinforcement for rocker cover 12.

Additional sealing capacity for rocker cover 12 is achieved by a small bead 151 formed around the periphery of the bottom of the rocker cover. Bead 151, an enlarged view of which is illustrated in FIG. 9E, bites into gasket 14 when the bolts 13 securing rocker cover 12 to rocker housing 10 are tightened, thereby blocking the passage of oil which would otherwise occur between gasket 14 and rocker cover 12 as the rocker cover vibrates during heavy engine operation.

Figures 9D, 10, 11:
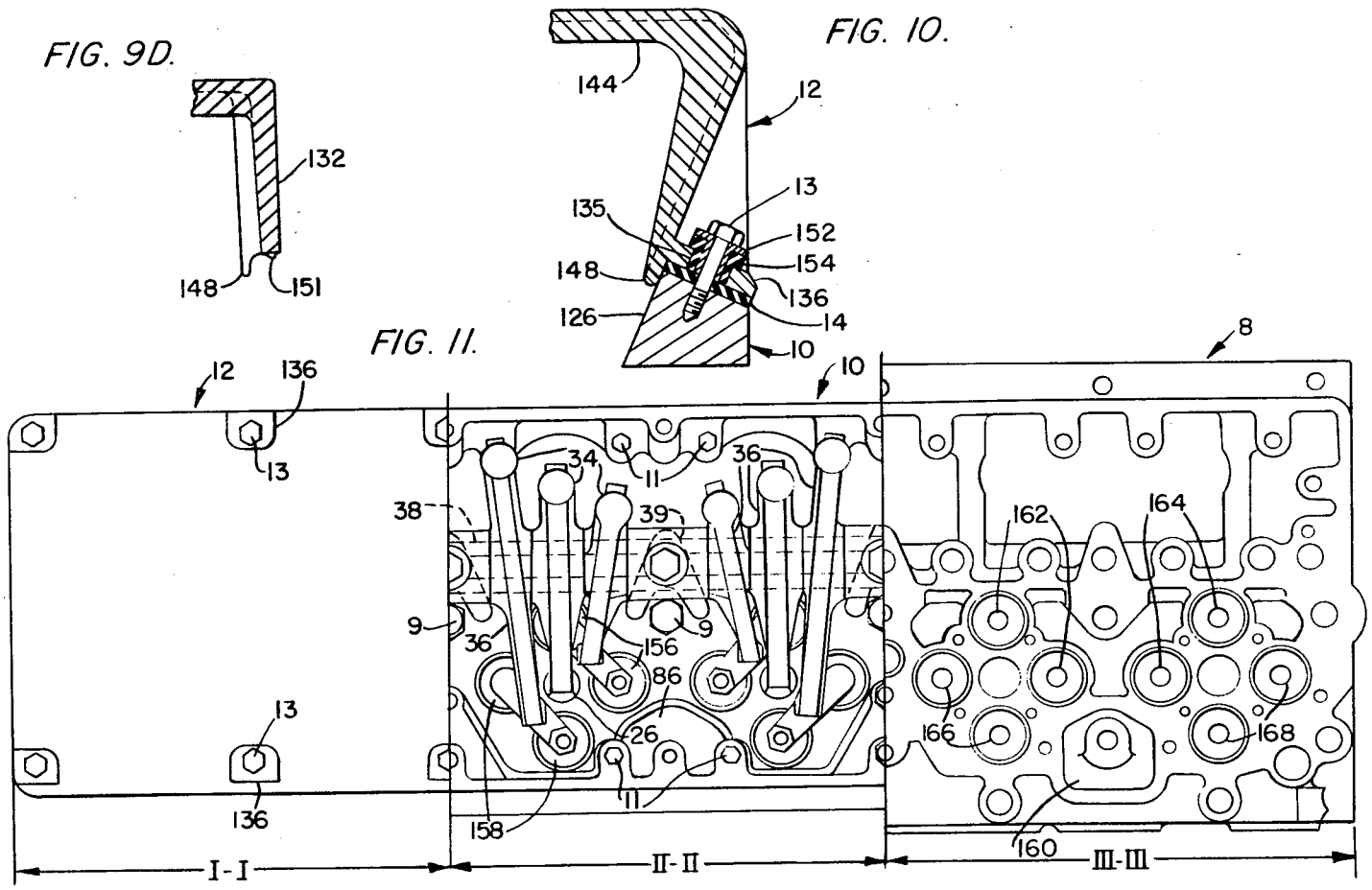
FIG. 10 is an enlarged view of the vibration-damping bolt assembly which secures the rocker cover to the rocker housing.
FIG. 11 is a top view of a multi-cylinder in-line diesel engine employing the rocker housing and rocker cover of the present invention, as seen along the various elevations indicated in FIG. 1.

Damping of vibration between rocker housing 10 and rocker cover 12 is achieved by means of the vibration-damping structure illustrated in FIG. 10. The rocker cover securing bolt 13 is surrounded by a steel sleeve 152. Steel sleeve 152 is in turn surrounded by an elastomeric grommet 154 inserted into hole 135 in the flange 136 of rocker cover 12. Grommet 154 is placed in substantial compression in order to yieldably urge flange 136 toward the upper surface of the rocker housing, thus clamping gasket 14 securely between the rocker housing and the rocker cover. The interface between grommet 154 and flange 136 acts to inhibit the transfer of vibration from rocker housing 10 to rocker cover 12 during operation of the engine. Steel sleeve 152 controls the compression of grommet 154 as bolt 13 is tightened.

FIG. 11 provides a top view of rocker cover 12, rocker housing 10 and cylinder head 8 at various elevations along the length of the engine as indicated by section lines I—I, II—II and III—III in FIG. 1. Section I—I illustrates the top of rocker cover 12, while rocker cover 12 has been removed in section II—II to reveal the rocker arm mechanism and fuel injector/valve assemblies surrounded by rocker housing 10. The arrangement of the fuel injector 26, paired intake valves 156 and paired exhaust valves 158 associated with each cylinder can be seen. Referring next to section III—III, the cylinder head air intake port which registers with rocker housing air intake passageway 88 is clearly illustrated at 160. Air intake port 160 receives pressurized air from the air intake plenum 60 in rocker housing 10 via rocker housing air intake passageway 88 and thereafter directs this pressurized air to the two adjacent cylinders located beneath section III—III. The two pairs of intake valve stem guides 162, 164 and the two pairs of exhaust valve stem guides 166, 168 which serve the adjacent cylinders are illustrated for the sake of clarity.

Figure 12:
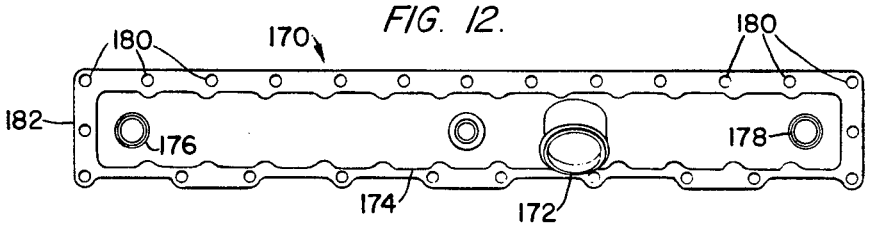
FIG. 12 is a side elevational view of an aftercooler unit which may be employed with the rocker housing of the present invention.
Figure 13:
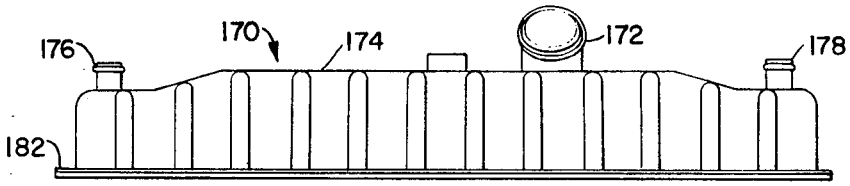
FIG. 13 is a bottom elevational view of the aftercooler unit illustrated in FIG. 12.
Figure 14:
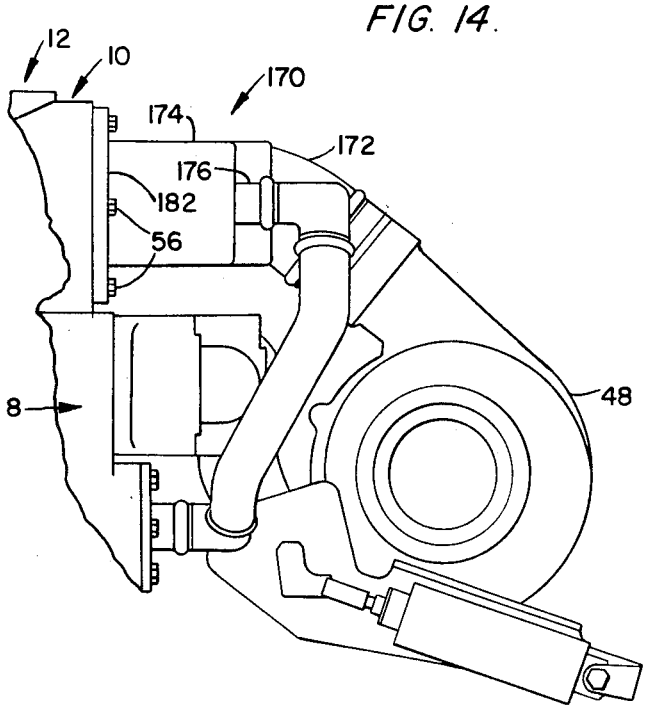
FIG. 14 shows the aftercooler unit of FIGS. 12 and 13 mounted in place between the rocker housing of the present invention and the engine turbocharger.

An optional aftercooler unit for use in combination with the present invention is illustrated in FIGS. 12 through 14. It has long been known that more efficient combustion can be achieved in an internal combustion engine by increasing the density of the air entering the engine cylinders. One means of obtaining such increased density is to extract heat from the intake air after the air has left the turbocharger compressor but prior to the entry of the air into the engine cylinders. This heat extraction may be accomplished by an aftercooler unit of the type available from Airesearch Industrial of Los Angeles, Calif., indicated generally at 170 in the top and side views respectively illustrated in FIGS. 12 and 13. In lieu of duct 52 and plate 54 connecting turbocharger 48 to the intake air plenum 60 in rocker housing 10, aftercooler 170 may be bolted to the front face 58 of the rocker housing. An intake duct 172 formed on the aftercooler housing 174 is then connected to receive air from the turbocharger compressor. Liquid coolant from the liquid coolant flow system of the engine circulates through the aftercooler via conduits 176 and 178 also formed on the aftercooler housing. A plurality of holes 180 are formed in a peripheral flange 182 surrounding the aftercooler housing. Each of the holes 180 corresponds to a threaded hole 70 in the periphery of rocker housing front face 58, thereby permitting bolts 56 (see FIG. 1) to secure the aftercooler housing directly to the rocker housing. As shown in FIG. 14, the unique orientation of the rocker housing 10 and air intake plenum 60 relative to turbocharger 48 makes possible the attachment of aftercooler 170 to the rocker housing without any major movement or structural modification of the engine components. By way of contrast, if air intake plenum 60 were instead cast into cylinder head 8, it would be necessary to completely re-position turbocharger 48 in order to accomodate the aftercooler unit.

INDUSTRIAL APPLICABILITY

A rocker housing and rocker cover constructed in accordance with the foregoing description can be advantageously employed with an internal combustion engine. The ability to cast the rocker housing out of aluminum, as opposed to heavier metals, results in a net reduction in the weight of the engine. Additional weight reductions are achieved by utilizing an air intake plenum in the rocker housing as a substitute for the conventional internal combustion engine intake manifold. Placement of air intake passageways in the rocker housing simplifies the casting of the engine cylinder head, leading to even further weight savings. Moreover, the simplified structure of the cylinder head permits greater economy to be achieved during the head casting operation, while the increased complexity of the rocker housing caused by the presence of the air intake passageways formed therein is offset by the fact that the mold for the aluminum rocker housing is reusable.

The rocker cover of the present invention, which may be molded from plastic, also contributes to the overall reduction in weight of the engine. Use of an oil drip lip and rubber bolt grommets in the rocker cover respectively minimizes oil leakage from the rocker housing/cover assembly and damps vibration transfer between the rocker housing and rocker cover. Consequently, quieter and more maintenance-free operation of the internal combustion engine can be attained.

In a turbocharged version of an engine employing the present invention, the unique placement of the rocker housing and rocker cover relative to the remainder of the engine permits easy attachment of a turbocharger aftercooler unit without the need for any significant structural modification or repositioning of the engine components.

Only one embodiment of the present invention has been shown and described in the specification. It is understood, however, that various additional changes and modifications in the form and detail of the novel rocker housing and rocker cover illustrated above may be made by those skilled in the art without departing from the scope and spirit of the present invention. It is, therefore, the intention of the inventor to be limited only by the following claims.

We claim:

1. A rocker cover for use on an internal combustion engine having a planar upper surface, a plurality of cylinders with intake and exhaust ports formed therein to permit the flow of gases respectively into and out of the cylinders, a plurality of intake and exhaust valve assemblies mounted on the engine to open and close respective intake and exhaust ports formed in the cylinders, a rocker arm mechanism also mounted on the engine in operative engagement with the intake and exhaust valve assemblies to control the flow of gases respectively into and out of the cylinders, and a gasket positioned on the planar upper surface of the engine which surrounds the rocker arm mechanism to provide an oil seal therefore, said rocker cover comprising an upper portion shaped to cover and protect the rocker arm mechanism, said upper portion including a plurality of reinforcing ribs formed in the inner surface thereof to extend both in a lateral direction and in a longitudinal direction, the height of said ribs extending in a longitudinal direction varying in a predetermined manner to provide clearance for the operation of the rocker arm mechanism, wherein the height of said ribs is greater at the extremities than in the center; a lower skirt portion shaped to contact the upper surface of the gasket surrounding the rocker arm mechanism; and fastening means for fastening said lower skirt portion to the planar upper surface of the engine so that the gasket is compressed between the lower skirt portion of said rocker cover and the engine, said lower skirt portion including integral flange means formed around the inner periphery of said lower skirt portion positioned to contact one edge of said gasket and to extend below the planar upper surface of the engine to divert any lubricants which collect on the inner surface of said rocker cover away from the gasket.

2. A rocker cover for use on an internal combustion engine having a planar upper surface, a plurality of cylinders with intake and exhaust ports formed therein to permit the flow of gases respectively into and out of the cylinders, a plurality of intake and exhaust ports formed in the cylinders, a rocker arm mechanism also mounted on the engine in operative engagement with the intake and exhaust valve assemblies to control the flow of gases respectively into and out of the cylinders, and a gasket positioned on the planar upper surface of the engine which surrounds the rocker arm mechanism to provide an oil seal therefore, said rocker cover comprising an inner surface, an integrally molded plastic upper portion shaped to cover and protect the rocker arm mechanism, an integrally molded plastic lower skirt portion shaped to contact the upper surface of the gasket surrounding the rocker arm mechanism, fastening means for fastening said lower skirt portion to the planar upper surface of the engine such that the gasket is compressed between said lower skirt portion of said rocker cover and the engine, and integral engaging means formed on said lower skirt portion of said rocker cover to engage the gasket when said gasket is compressed and minimize the leakage of oil therefrom when said rocker cover is fastened to the engine, and internal reinforcing ribs formed on the inner surface of said rocker cover, said internal reinforcing ribs including a plurality of lateral reinforcing ribs and at least one series of aligned longitudinal reinforcing ribs formed between said lateral ribs.

3. A rocker cover as set forth in claim 2, wherein said engaging means is a bead formed around the periphery of said lower portion.

4. A rocker cover as set forth in claim 2, wherein the height of said longitudinal reinforcing ribs varies in a pre-determined manner in order to provide clearance for the operation of the rocker arm mechanism.

5. A rocker cover as set forth in claim 2, wherein the firing information for the engine cylinders is molded into said rocker cover.

6. A rocker cover as set forth in claim 2, wherein a flange means is formed around the outer periphery of said lower skirt portion of said rocker cover to divert any lubricants which collect on the inner surface of said rocker cover away from the gasket.

7. A rocker cover as set forth in claim 2, wherein said fastening means includes at least one rigid element which is releasably securable to the engine, said fastening means also including a resilient means which spaces said rigid element from said lower portion such that the transfer of vibrations between the engine and said rocker cover is damped.

8. A rocker cover as set forth in claim 7, wherein said resilient means is placed in compression to yieldably urge said lower skirt portion of said rocker cover towards the engine when said rigid element is secured to the engine.

9. A rocker cover as set forth in claim 8, wherein a rigid sleeve means is interposed between said rigid element and said resilient means to control the compression of said resilient means when said rigid element is secured to the engine.

10. A rocker cover as set forth in claim 9, wherein said resilient means is a rubber grommet.

11. A rocker cover as set forth in claim 10, wherein said lower portion of said rocker cover has at least one opening into which said grommet is inserted and said rigid element includes a shaft extending through said grommet.

12. A rocker cover for use on an internal combustion engine having a planar upper surface, a plurality of clyinders with intake and exhaust ports formed therein to permit the flow of gases respectively into and out of the cylinders, a plurality of intake and exhaust valve assemblies mounted on the engine to open and close respective intake and exhaust ports formed in the cylinders, a rocker arm mechanism also mounted on the engine in operative engagement with the intake and exhaust valve assemblies to control the flow of gases respectively into and out of the cylinders, and a gasket positioned on the planar upper surface of the engine which surrounds the rocker arm mechanism to provide an oil seal therefore, said rocker cover comprisings an inner surface, an upper portion shaped to cover and protect the rocker arm mechanism, a lower skirt position shaped to contact the upper surface of the gasket surrounding the rocker arm mechanism, fastening means for fastening said lower skirt portion to the planar upper surface of the engine such that the gasket is compressed between said lower skirt position of said rocker cover and the engine, said lower skirt portion including integral flange means formed around the inner periphery of said lower skirt portion positioned to contact one edge of said gasket and to extend below the planar upper surface of the engine to divert any lubricants which collect on the inner surface of said rocker cover away from the gasket, and internal reinforcing ribs formed on the inner surface of said rocker cover, said internal reinforcing ribs including a plurality of lateral reinforcing ribs and at least one series of aligned longitudinal reinforcing ribs formed between said lateral reinforcing ribs.

13. A rocker cover as set forth in claim 12, wherein the height of said longitudinal reinforcing ribs varies in a predetermined manner in order to provide clearance for the operation of the rocker arm mechanism.

14. A rocker cover as set forth in claim 12, wherein a bead is also formed around the outer periphery of said lower skirt portion of said rocker cover to engage the gasket when said rocker cover is fastened to the engine in order to minimize the leakage of oil from the gasket.

15. A rocker cover as set forth in claim 12, wherein said upper and lower portions are integrally molded from plastic.

16. A rocker cover as set forth in claim 15, wherein the firing information for the engine cylinders is molded into said rocker cover.

17. A rocker cover as set forth in claim 12, wherein said fastening means includes at least one rigid element which is releasably securable to the engine, said fastening means also including a resilient means which spaces said rigid element from said lower skirt portion such that the transfer of vibrations between the engine and said rocker cover is damped.

18. A rocker cover as set forth in claim 17, wherein said resilient means is placed in compression to yieldably urge said lower skirt portion of said rocker cover towards the engine when said rigid element is secured to the engine.

19. A rocker cover as set forth in claim 18, wherein a rigid sleeve means is interposed between said rigid element and said resilient means to control the compression of said resilient means when said rigid element is secured to the engine.

20. A rocker cover as set forth in claim 19, wherein said resilient means is a rubber grommet.

21. A rocker cover as set forth in claim 20, wherein said lower skirt portion of said rocker cover has at least one opening into which said grommet is inserted and said rigid element includes a shaft extending through said grommet.

* * * * *